United States Patent [19]

Chapman

[11] Patent Number: 4,870,825

[45] Date of Patent: Oct. 3, 1989

[54] ROTARY FUEL INJECTION SYSTEM

[75] Inventor: William I. Chapman, Birmingham, Mich.

[73] Assignee: Williams International Corporation, Walled Lake, Mich.

[21] Appl. No.: 204,268

[22] Filed: Jun. 9, 1988

[51] Int. Cl.[4] ..... F02C 7/22
[52] U.S. Cl. ..... 60/745
[58] Field of Search ..... 60/745, 740, 741, 744, 60/39.161, 734

[56] References Cited

U.S. PATENT DOCUMENTS

| | | | |
|---|---|---|---|
| 4,040,251 | 8/1977 | Heitmann et al. | 60/745 |
| 4,598,544 | 7/1986 | Williams et al. | 60/745 |
| 4,769,996 | 9/1988 | Barbeau | 60/745 |

*Primary Examiner*—Louis J. Casaregola
*Assistant Examiner*—Timothy S. Thorpe
*Attorney, Agent, or Firm*—Lyman R. Lyon

[57] ABSTRACT

A fuel slinger for a gas turbine is provided with a hydraulic fuel trap within the U-shaped cross section thereof to inject fuel metered by a low pressure fuel system into a combustion chamber at relatively higher pressure.

1 Claim, 1 Drawing Sheet

ROTARY FUEL INJECTION SYSTEM

BACKGROUND OF THE INVENTION

The invention relates generally to a rotary fuel injection system for a turbine engine having an annular combustion chamber, and more particularly to a rotary fuel injection system having a hydraulic trap to maintain a desired pressure differential across the fuel injector.

Known rotary fuel injection systems or "fuel slingers" generally comprise an axially extending annular channel having a number of radially extending passages that project fuel by centrifugal force into an annular combustion chamber. the annular channel and radial passages of the fuel slinger are often an integral part of the rotating compressor-turbine shaft. Since centrifugal force causes fuel in the slinger to spread out in an annular layer on the cylindrical wall of the channel, the fuel acquires the tangenitial velocity of the fuel slinger and is thrown off into the combustion chamber at this velocity. Normally, control of the flow rate is effected upstream of the fuel slinger. Such fuel injection systems are illustrated in, U.S. Pat. Nos. 2,416,389; 2,547,959 and 2,938,345 and 3,983,694.

SUMMARY OF THE INVENTION

The rotary fuel slinger of the present invention permits use of a low pressure fuel system that is relatively efficient, easily controlled, and inexpensively manufactured. An annular fuel slinger of cup shaped radial cross section has a lip at an open end delimiting an annular fuel reservoir. Fuel is metered and supplied to the annular reservoir by a low pressure fuel system. A fuel trap within the annular reservoir in combination with centrifugal force generates the differential pressure needed to inject the fuel into the combustion chamber.

DETAILED DESCRIPTION OF THE PREFERRED EMBODIMENT OF THE INVENTION

Figure 1:
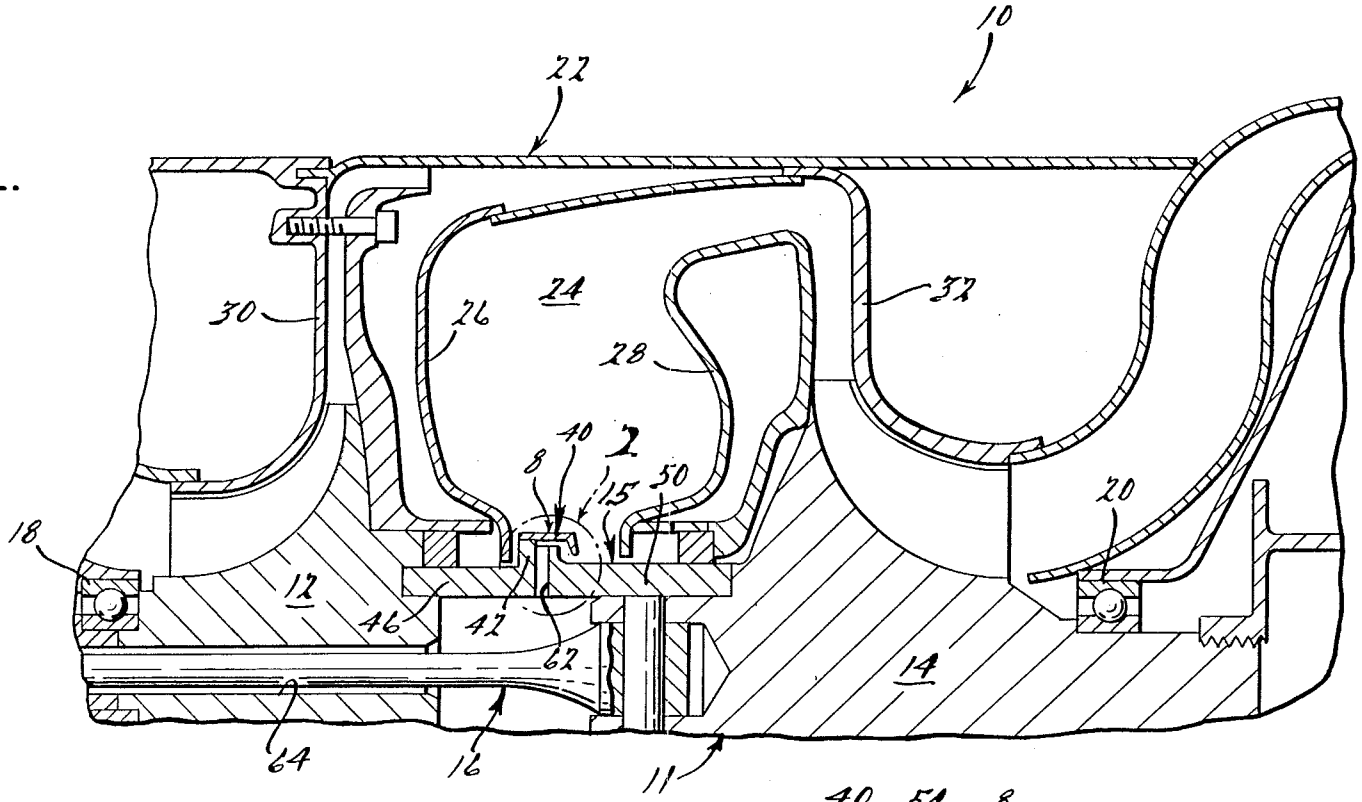
FIG. 1 is a fragmentary, sectional view of a gas turbine engine taken on a plane passing through its center line and embodying features of the invention.

As seen in FIG. 1 a fuel slinger 8, in accordance with a preferred embodiment of the instant invention is shown in the environment of a single shaft gas turbine engine 10. The engine 10 comprises a shaft assembly 11 including a radial outflow compressor 12 and a radial inflow turbine 14 axially spaced from one another and interconnected by a centrally disposed hollow shaft sleeve 15 and tie bolt 16. The shaft assembly 11 is supported for rotation by a pair of bearings 18 and 20 and is connected to appropriate power take-off means, not illustrated, to remove shaft horsepower from the engine 10.

A housing 22 of the engine 10 encloses an annular combustion chamber 24, defined by axially spaced radially extending liners 26 and 28. The housing 22 includes radial wall portions 30 and 32 which shroud the blades of the compressor 12 and the turbine 14, respectively.

Figure 2:
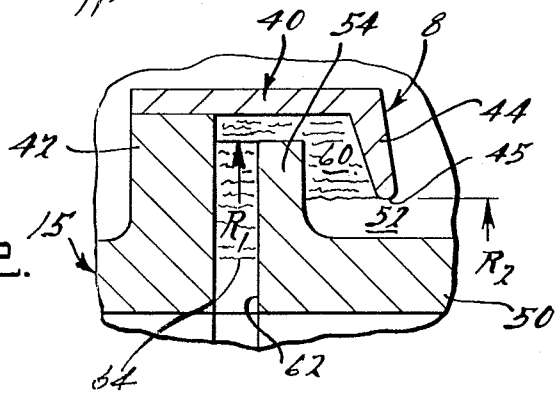
FIG. 2 is an enlarged view taken within the circle "2" of FIG. 1.

As best seen in FIG. 2, the fuel slinger 8 is of annular cup shaped radial cross section defined by a cylindrical radially outer axially extending slinger sleeve 40 that is mounted on a radially extending wall 42 portion of the shaft sleeve 15. The slinger sleeve 40 has a radially inwardly extending wall portion 44 that defines a fuel discharge lip 45 at the radially inner diameter thereof. The radial wall portion 42 of the sleeve 15 is integral with an end portion 46 thereof which is supported by the compressor 12 for rotation therewith. The discharge lip 45 on the radially inwardly extending wall portion 44 of the slinger sleeve 40 has a radius $R_2$ that is of greater radial dimension than an end portion 50 of the cylindrical sleeve 15 thereby to define a fuel discharge annulus 52. The end portion 50 of the shaft sleeve 15 is supported by the turbine 14, for rotation therewith.

In accordance with the present invention the sleeve shaft 15 is provided with a flange 54 that extends radially outwardly to a radius $R_1$ that is greater than the radius $R_2$ of the lip 45 on the wall 44 of the slinger sleeve 40 but less than the inside diameter of the slinger sleeve 40 thereby to define a hydraulic fuel trap 60. Fuel is fed into the fuel trap 60 of the fuel slinger 8 through one or more holes 62 from the interior 64 of the hollow compressor shaft 12 and shaft sleeve 15. Fuel must pass over the radially outer extremity of the flange 54 on the shaft sleeve 15 at the radius $R_1$ before it can leave the trap 60 of the slinger 8 across the smaller radius $R_2$ on the lip 45 of the wall 44 on the slinger sleeve 40.

In operation, the trap 60 of the slinger 8 runs full of fuel due to centrifugal force. The inlet hole 62 thereof will fill to a level 64 dictated by the fuel pressure differential between the hollow interior of the shaft sleeve 15 and the combustor 24. In all cases the fuel level 64 is a radial dimension less than that of the radius of the discharge lip 45 of the slinger sleeve 40. The hydraulic fuel trap 60 results in and permits use of a low pressure fuel system that suplies fuel to the interior of shaft sleeve 15 by, for example, a conventional free jet or low pressure differential seal (not shown).

Because $R_1$ is larger than $R_2$, centrifugal force on fuel in the trap 60 forces the fuel over the lip 45 at $R_2$ against the pressure in the combustor 24. Because fuel pressure in the shaft sleeve 15 is lower than combustor pressure, the holes 62 in the shaft sleeve 15 in conjunction with the fuel trap 60 function as a centrifugal pump.

From the foregoing it should be apparent that fuel flow can be initially metered by a low pressure fuel system that supplies fuel to the interior of the shaft sleeve 15. Stated in another manner, the fuel slinger 8 functions as an auxiliary pump to inject fuel into combustor 24 even though it is at higher pressure than the pressure of fuel internally of the shaft sleeve 15.

While the preferred embodiment of the invention has been disclosed, it should be appreciated that the invention is susceptible of modification without departing from the scope of the following claims.

I claim:

1. A gas turbine comprising a compressor, a turbine, an axially extending cylindrical shaft sleeve mounted for rotation with said compressor and turbine, an annular combustion chamber encircling a portion of the shaft sleeve and in direct communication therewith, whereby said shaft sleeve defines a radially inner wall of said combustion chamber, a fuel slinger for injecting fuel from the interior of said shaft sleeve directly into said combustion chamber comprising a cylindrical axially extending impervious slinger sleeve concentric with the shaft axis and spaced radially outwardly therefrom, a first radial wall extending outwardly from the shaft sleeve of said turbine to the slinger sleeve, a second radial wall portion extending radially inwardly from the slinger sleeve toward said shaft sleeve but terminating in spaced relation thereto so as to define a fuel discharge lip, means for supplying fuel to said fuel slinger, and a third radially outwardly extending wall on said shaft sleeve between said first and second radially extending walls, said third wall terminating in radially spaced relation to the slinger sleeve portion of said fuel slinger but extending radially outwardly to a diameter greater than the diameter of the fuel discharge lip on said second wall portion so as to define a generally U-shaped hydraulic trap whereby relatively low pressure fuel from said supply means is pressurized by centrifugal force in said fuel trap for injection over said discharge lip directly into the combustion chamber of said engine.

* * * * *